US005348770A

United States Patent [19]

Sievers et al.

[11] Patent Number: 5,348,770

[45] Date of Patent: Sep. 20, 1994

[54] METHOD OF FORMING AN UNINTERRUPTED REFRACTORY COATING ON A DOWNHOLE DRILL BIT CONE

[76] Inventors: G. Kelly Sievers, 24232 Creekside Dr., Santa Clarita, Calif. 91321; Rajan K. Bamola, 509 E. San Jose Ave., Apt. No. 14, Burbank, Calif. 91501

[21] Appl. No.: 878,202

[22] Filed: May 4, 1992

Related U.S. Application Data

[63] Continuation of Ser. No. 569,186, Aug. 17, 1990, abandoned.

[51] Int. Cl.[5] ..... C23C 4/00

[52] U.S. Cl. ..... 427/422; 427/450; 427/451; 175/374; 175/375; 175/426

[58] Field of Search ..... 427/422, 410, 450, 451; 175/374, 426, 375

[56] References Cited

U.S. PATENT DOCUMENTS

| | | | |
|---|---|---|---|
| 4,372,404 | 2/1983 | Drake | 175/374 |
| 4,396,077 | 8/1983 | Radtke | 175/393 |
| 4,592,252 | 6/1986 | Ecer | 76/108.2 |
| 4,593,776 | 6/1986 | Salesky | 175/375 |
| 4,597,456 | 7/1986 | Ecer | 76/108.2 |
| 5,019,686 | 5/1991 | Marantz | 427/423 |
| 5,206,059 | 4/1993 | Marantz | 427/472 |

*Primary Examiner*—Shrive Beck
*Assistant Examiner*—V. Duong Dang
*Attorney, Agent, or Firm*—Louis J. Bachand

[57] ABSTRACT

Drill bits having projecting inserts are completely coated with refractory material including on the edge margins about the inserts by thermally spraying with refractory particles whose particulate constituent under the spraying conditions is able to penetrate the inserts. Completely coated drill bits are provided.

16 Claims, 2 Drawing Sheets

METHOD OF FORMING AN UNINTERRUPTED REFRACTORY COATING ON A DOWNHOLE DRILL BIT CONE

This is a continuation of copending application Ser. No. 07/569,186 filed on Aug. 17, 1990 now abandoned.

TECHNICAL FIELD

This invention has to do with drill bit cones for downhole drilling, mining, rock face drilling and the like, and is more particularly concerned with improvements in drill bit cones in an area of likely failure, retention of the bit inserts in the bit cone body.

The invention provides a previously unattainable product: a downhole drill bit cone entirely coated on all exposed surface areas with a hardfacing of tungsten carbide.

BACKGROUND OF THE INVENTION

Drilling in the earth is commonly effected by forcing a drill having a plurality of drill bits, each holding a plurality of cones set at outward angles, through the earth formations, essentially crushing the formations. The drill bit cones rotate on their axes and are in turn rotated about the drill bit main axis, which can be the axis of a drill string in oil field drilling for example.

Drill bit cones are typically high strength alloy steel shaped into approximately conical configurations, provided with bearings and rollers and mounting a plurality of inserts, typically tungsten carbide inserts, which are usually soldered into preformed pockets distributed circumferentially around the bit cone body, the inserts being of sufficient length to project from the bit cone body a distance to maximize the crushing forces on the earth formation surrounding the drill bit.

SUMMARY OF THE INVENTION

While wear of the inserts theoretically limits useful life of the drill bit, practically speaking many inserts are lost before they wear out, because the supporting cone pockets wear out before the inserts wear out, and the not fully worn inserts drop out of the pockets.

Drill bit cone bodies have been given hardened surfaces by application of relatively harder coatings, such as tungsten carbide, but the portion of the bit cone body immediately surrounding the insert-receiving pocket, a "halo" defined by the edge margin of the pocket, has not been successfully treated in the typical drill bit cone, because the tungsten carbide, applied by previously known high velocity spraying techniques will not cover the tungsten carbide insert or the immediately surrounding area, the pocket edge margin. A halo of uncoated area develops during spraying, possibly as a result of sprayed facing material bouncing off the insert and blocking coverage of the area immediately adjacent the insert. Thus, in use, the pocket edge margin between the coated bit cone body and the tungsten carbide insert is relatively unprotected and wears prematurely, providing less support over time to the insert within, and ultimately, the insert drops from the bit cone body.

Amelioration of this condition cannot be effected by first coating the bit cone body and then forming the pockets or by inserting the inserts only after coating, since necessary heating of the bit cone in manufacturing operations tends to cause the coating to fall off.

It has now been discovered that insert pocket edge margins, and the entire bit cone body can be coated with tungsten carbide or other refractory, hardfacing material by applying a suitably sized and driven material to the body under conditions such that the material will form a penetration coating on the inserts. Under these conditions the edge margins around the insert pockets are coated and protected as well. In a preferred mode, the inserts are exposed to the coating material and a penetration coating formed thereon. In such embodiments, the coating on the inserts and the coating on the drill bit cone body join in a bridge coating on the pocket edge margin and excellently protect the hitherto unprotected area of the drill bit cone. While not wishing to be bound to any a particular theory of operation, it is believed that the ability of the coating spray to penetrate the insert material reduces or eliminates bounced particles and their blocking of coating in the pocket edge margin area, so continuous, uninterrupted coatings free of holidays are realized. The coatings made in accordance with the invention have been observed to extend in a smooth arc from the vertically disposed inserts over the edge margin area and onto the horizontally disposed cone body surfaces thereadjacent.

The invention thus provides the first drill bit cone which is entirely protected on all exposed surfaces with a hardface coating, e.g. of tungsten carbide.

In particular, in accordance with the invention, there is provided a refractory material coated, insert bearing downhole drill bit cone free of holidays in the refractory material coating immediately around said inserts.

In preferred embodiments, there is provided a downhole drill bit cone in which the drill bit cone comprises an alloy steel body, the drill bit inserts comprise tungsten carbide, the refractory material comprises a refractory metal carbide, and the refractory material more particularly comprises tungsten carbide.

Additionally, the inserts are inserted in pockets in the cone body of the drill bit, and the coating extends uninterruptedly from drill bit cone body to the adjacent insert across the edge margin of the pocket. In this just mentioned embodiment, as in the previous embodiments, the drill bit cone typically comprises an alloy steel body, the drill bit inserts comprise tungsten carbide, the refractory material comprises a refractory metal carbide, the refractory material typically comprises tungsten carbide, and the refractory material forms a penetrating tungsten carbide coating on the tungsten carbide inserts.

In another embodiment, the invention provides a drill bit insert comprising a monolithic, generally cylindrical body of tungsten carbide, the body having a penetration coating of refractory material on at least a portion of the body surface. In this and like embodiments, the refractory material is tungsten carbide, and the coating tungsten carbide is comprised of smaller size particles of tungsten carbide than the insert body.

In another embodiment, the invention provides a drill bit cone having a plurality of refractory inserts projecting from a pockets in the bit cone body, the bit being uninterruptedly coated in the region of the inserts with a refractory coating under conditions such that the refractory inserts receive a penetrating coating of the refractory material, the coating conditions include thermally spraying refractory particles onto the bit in the regions to be covered at temperatures, feed rates, and particle sizes such that the refractory inserts are penetration coated, the refractory particles being thermally sprayed comprise a metal binder and refractory particulate which is smaller than the particulate of the refractory of which the inserts are comprised, whereby the particle particulate penetrates the inserts between the insert particulates, the particles are fed at rates between 1 and 12 pounds per hour, the particles are in the range of 10 to 33 microns in size, the particles comprise tungsten carbide particles in the amount of 85 to 92 per cent by weight and a cobalt binder in the amount of 8 to 15 per cent by weight, the temperature and velocity of the tungsten carbide particles being sprayed are such that the metal binder of particles melts and upon striking the drill bit cone the particles flatten themselves against the cone surface in refractory particulate covering relation, and the spray velocity is in excess of 730 meters per second.

In yet another embodiment, the invention provides a drill bit cone having a plurality of refractory inserts projecting from pockets in the bit cone body, the cone being uninterruptedly coated with a refractory coating under conditions such that the refractory inserts receive a penetrating coating of the refractory material.

In this and like embodiments, the coating conditions include thermally spraying refractory particles onto the cone in the regions to be covered at temperatures, feed rates, angle of impingement and particle sizes such that the refractory inserts are penetration coated, the refractory particles being thermally sprayed comprise a metal binder and refractory particulate which is smaller than the particulate of the refractory of which the inserts are comprised, and are sprayed substantially normal to the surface being coated, whereby the particle particulate penetrates the inserts between the insert particulates, the particles are fed at rates between 1 and 12 pounds per hour, the particles are in the range of 10 to 33 microns in size, the particles comprise tungsten carbide particles and a cobalt binder in the amount of 8 to 15 per cent by weight, the temperature and velocity of the refractory material particles being sprayed are such that the metal binder of particles softens sufficiently that upon striking the drill bit cone the particles flatten themselves against the cone surface in refractory particulate retaining relation, and the spray velocity is in excess of 730 meters per second and the angle of impingement substantially normal to the surface to be coated.

The invention further provides the method of coating a drill bit cone having refractory inserts projecting therefrom out of supporting pockets, including thermally spraying refractory particles comprising binder and refractory particulate under conditions forming a penetrating coating on the inserts, and directing the refractory particles against the edge margin of the supporting pockets in coating forming relation at that locus.

In this and like embodiments the method of the invention can also include spraying the particles at a temperature sufficient to soften or melt the binder to a condition to flatten against the bit cone, selecting tungsten carbide as the refractory particulate, selecting cobalt at from 9 to 12% by weight of the particles as the binder, selecting tungsten carbide inserts as the inserts, directing the spraying substantially normal to the cone surfaces, spraying the refractory particles at feed rates from 1 to 12 pounds per hour, selecting particulate in the particles from 10 to 33 microns in particle size, effecting a secondary combustion of fuel beyond the first combustion, and selecting tungsten carbide as the refractory particulate.

In a particularly preferred form of the invention, there is further included selecting cobalt at from 9 to 12% by weight of the particle as the binder, selecting tungsten carbide inserts as the inserts, directing the spraying substantially normal to the cone surfaces, spraying the tungsten carbide refractory particles at feed rates from 1 to 12 pounds per hour, selecting tungsten carbide particulate in the particles from 10 to 33 microns in particle size, and effecting a secondary combustion of fuel beyond the first combustion.

In a further aspect of the invention, there is provided the method of completely coating drill bit cones having projecting refractory inserts by thermal spray of refractory particles, including selecting the content of the particles to be materials able to penetrate the refractory inserts under thermal spraying conditions, and applying the particles to the drill bit cone.

In yet another aspect of the invention, there is provided the method of coating an object by thermal spraying, including effecting a secondary combustion of fuel downstream of the first combustion.

THE DRAWING

The invention will be further described in conjunction with the attached drawings in which.

PREFERRED MODES

The invention will be particularly described as to a downhole drill bit cone embodiment, but the invention is applicable to a variety of objects which can benefit from application of hard, refractory coatings including such products as are mentioned hereinabove.

Figure 1:
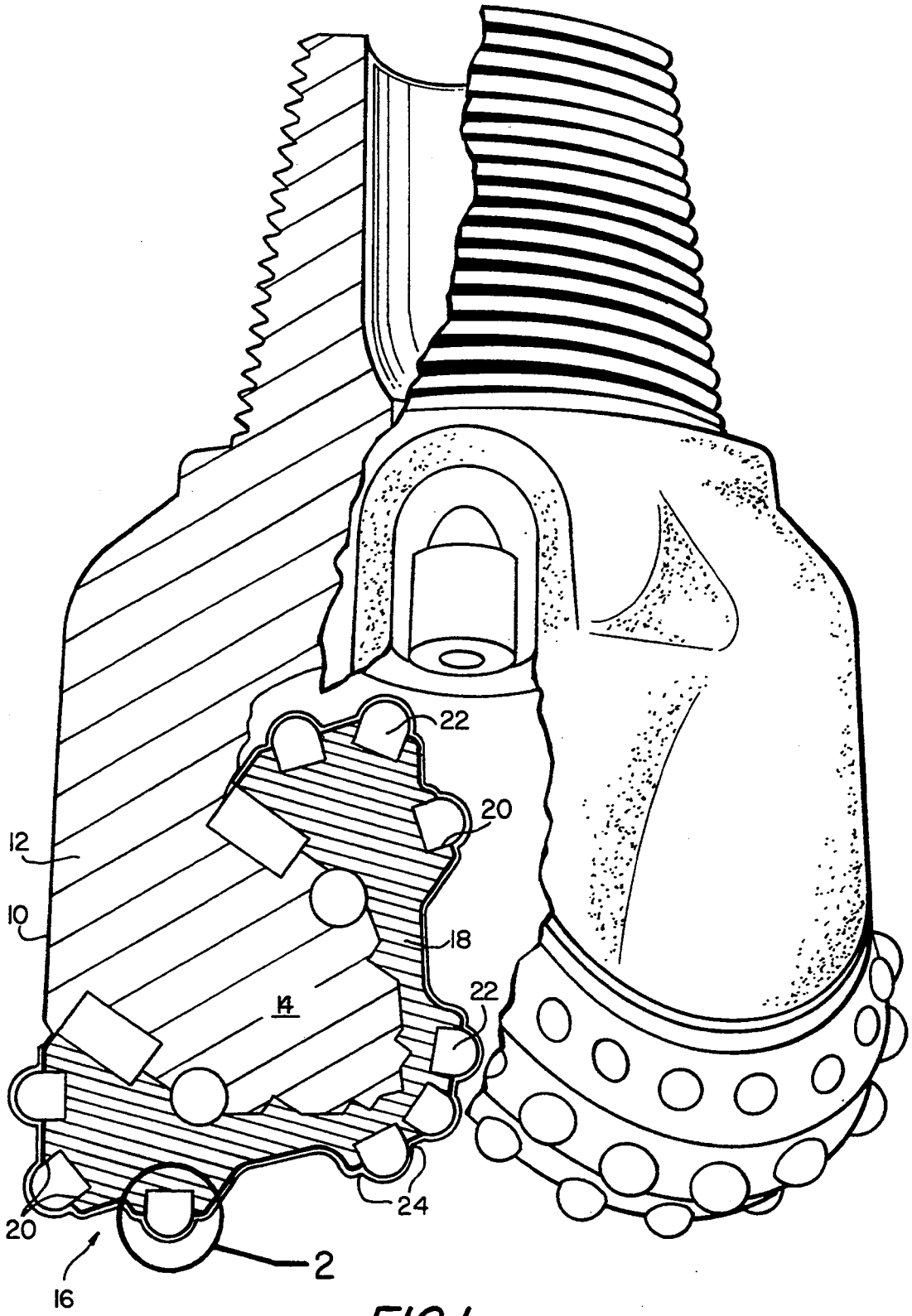
FIG. 1 is a view in section of a drill bit cone having a series of cones bearing inserts rotatably mounted thereon, with the coating profile somewhat exaggerated for clarity.

With reference now to the drawings in detail, in FIG. 1 a conventionally shaped drill bit 10 is shown to include a rotatable drill bit body 12 having a spindle 14 mounting an axially rotatable drill bit cone 16 having a steel alloy body 18 with a series of cylindrical pockets 20 formed therein circumferentially spaced about the perimeter of the cone body. The cone 16 has several series of pockets which are but illustrative of numerous possible patterns of pockets. Inserts 22 are placed in each pocket 20 at a depth to radiate outward from the bit body 18. Inserts 22 are typically slightly outwardly tapering cylinders of tungsten carbide, 85–92% by weight or higher or lower, in a cobalt, or nickel binder at 8–15% by weight, or higher or lower. The inserts 22 are conventionally secured in pockets 20 with silver solder or like material.

The edge margins about the pockets are shown at 24. Unconventionally, and in accordance with the present invention, this area 24 is coated in accordance with the invention, as will be subsequently described.

Figure 2:
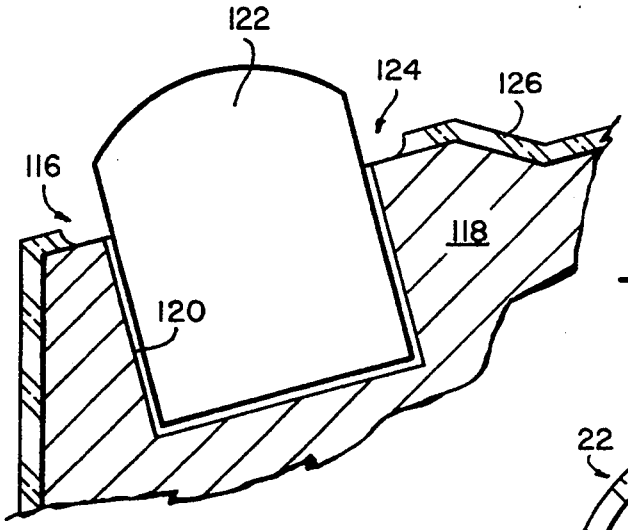
FIG. 2 prior art
FIG. 2 is a PRIOR ART fragmentary view largely in section of a drill bit cone and insert, illustrating the halo of non-coating around the insert.

With reference now to PRIOR ART FIG. 2, it is common practice to coat a cone body 118 with a hardfacing material, generally indicated at 126, and typically of a refractory material, particularly a refractory carbide material, and preferably a tungsten carbide material, such as those mentioned above. The coating 126 is put on to reduce wear of the cone body 118 in use in downhole situations. While the inserts 122 bear the brunt of the application of crushing forces onto surrounding rock formations, the cone body 118 is subjected to wear from broken rock and particle slurries in which the bit turns, and will wear unduly rapidly unless protected.

The edge margin area 124 around the inserts 122 is perforce usually left uncoated, as mentioned above, and obviously will wear more rapidly than the surrounding portions of the body, e.g. at the edge margin 124 of the pocket 120. This omission to coat is caused characteristically by the presence of the inserts 122 as a result of the process used to coat drill bit cone body 118. The process used is termed thermal spray and while a variety of types of thermal spraying are known, all basically involve high velocity ballistic application of particles onto a target surface, typically by feeding a powder of metal or refractory into the gaseous effluent of a combustion chamber into which fuel in the form of hydrocarbons and oxygen are fed. The powder is heated to very high temperatures e.g. 2700° to 3500° F. and then expressed from the combustion chamber at very high velocities onto the target where it impacts, spreading and embedding itself into or onto the surface in a tenacious manner. High build-ups of coatings 126 can be made in this manner and since the wear life of a bit will be determined largely by attrition it is desirable to form heavier coatings rather than lighter. Thermal spray, however, has not been effective at the edge margin portions 124 around the pockets 120, apparently due to the high velocity particles bouncing off the inserts 122 and blocking deposit of coating material in the halo area defined by the edge margin 124. When these areas 124 are not coated they wear relatively rapidly and permit the inserts 122 to fall out as walls of the pockets 120 disappear. Further the inserts 122 themselves are not coated with a coating material 126 in the prior art. The prior art cone 116 accordingly comprises a cone body 118 with inserts 122, an unprotected edge margin 124 about the inserts and no coating 126 on the inserts themselves, as shown in FIG. 2., or on the pocket 120 edge margins 124, leaving an annular gap in the coating, shown at 130 in FIG. 2.

Figure 3:
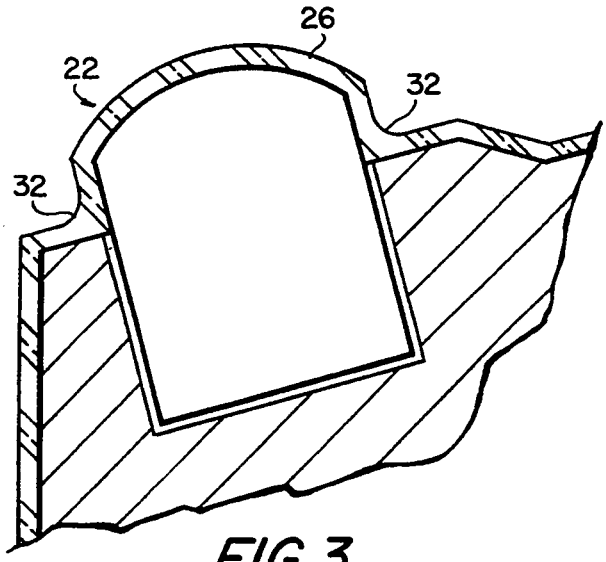
FIG. 3 is like FIG. 2, but taken on line 2—2 in FIG. 1 and illustrating the complete coating coverage of cone and insert according to the invention; and, FIG. 4 is a schematic view of the spraying apparatus.

With reference now to FIG. 3, in the present invention, adequate levels of coating 26 are realized in these halo areas defined by the edge margins 24. As a result, for the first time a totally coated drill bit cone 16 is realizable, even the edge margin areas 24 and the inserts 22 as well are coated, if desired.

While not wishing to be bound to any particular theory of operation, observation and data suggest that this result is realized because a build-up of coating 26 occurs in the immediate vicinity of the inserts 22. This result is unlike past efforts with thermal spraying. This build-up may be realized because the powder flowed to the target cone body 18 rather than bouncing from the inserts 22 is capable of penetrating the inserts and does not bounce back and does not block deposits into the edge margin area 24. In fact, bridges of coating 32 are noted between the insert 22 and the cone body 18, see FIG. 3, and the entire bit cone 16 is coated, See FIG. 1. Contrast with the cone in FIG. 2. This property of surface penetration of the insert 22 achieved in this invention is referred to as "penetration coating" and "penetrating coating" and their cognitives. These terms refer to the phenomenon of having incursion of the particulates of the powder particles into the surface layer of the tungsten carbide/cobalt binder constituted insert 22. That is, rather than have the powder particles bounce off the inserts and block incoming spray material from reaching the margin area 24, the particles penetrate and bounce back does not prevent incoming particles from reaching even the edge margins 24 on the body 18.

Figure 4:
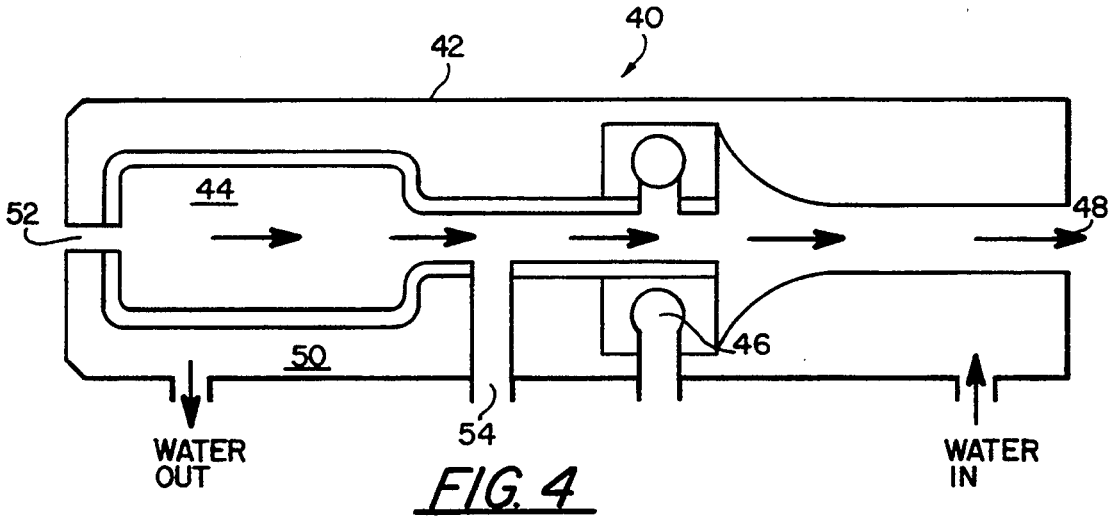

The described spraying is carried out with a gun as shown in FIG. 4. The gun 40 comprises a barrel 42 having rearwardly a first combustion chamber 44, midway a second combustion chamber 46, and forwardly a nozzle 48. The barrel 42 defines a water jacket 50 with inlets and outlets as shown. A combustible fuel air mixture is fed from inlet 52 into the first combustion chamber 44. Powder to be sprayed is fed through inlet 54 into the conbustion gases exiting the first combustion chamber 44. The heated powder is passed through secondary combustion chamber 46 where additional fuel is used to continue combustion, and the twice heated powder is expelled through nozzle 48.

Typical operating conditions for the gun include directing the gun output substantially normal to the target surface, feeding powder at rates between 1 and 20 pounds per hour, using tungsten carbide powders in the range of 10 to 33 microns in size with binder contents of cobalt or nickel in the range of 8–15% by weight, and maintaining melted powder spray velocities in excess of 730 meters per second.

The result of so spraying a bit cone are shown in FIG. 1, the entire cone and inserts are coated including the former halo area about the inserts.

We claim:

1. Method of coating a drill bit having refractory inserts projecting therefrom out of supporting pockets having edge margins surrounding said inserts, including thermally spraying refractory particles comprising binder and refractory particulate against the bit and inserts under conditions such that said refractory particles penetrate said inserts and do not bounce back from said inserts so as to leave said edge margins about said inserts uncoated, whereby said thermally sprayed refractory particle coating on said inserts and on said bit join in a bridge coating on said pocket edge margins to form a continuous, uninterrupted coating over said bit and said inserts which protects said edge margins.

2. The method according to claim 1, including spraying said particles at a temperature sufficient to soften said binder for flattening against said bit.

3. The method according to claim 1, including selecting tungsten carbide as said refractory particulate.

4. The method according to claim 1, including selecting cobalt at from 9 to 12% by weight of said particles as said binder.

5. The method according to claim 1, including selecting tungsten carbide inserts as said inserts.

6. The method according to claim 1, including directing said spraying substantially normal to the surfaces of said bit.

7. Method according to claim 1, including spraying said refractory particles at feed rates from 1 to 12 pounds per hour.

8. Method according to claim 1, including selecting particulate wherein said particles are from 10 to 33 microns in particle size.

9. Method according to claim 1, including effecting a first combustion of fuel in a first chamber to thermally spray said refractory particles and effecting a secondary combustion of fuel in a physically separated second chamber beyond said first combustion chamber to further effect thermal spray of said refractory particles in twice heated condition.

10. The method according to claim 2, including selecting tungsten carbide as said refractory particulate.

11. The method according to claim 10, including selecting cobalt at from 9 to 12% by weight of said particle as said binder.

12. The method according to claim 11, including selecting tungsten carbide inserts as said inserts.

13. The method according to claim 12, including directing said spraying substantially normal to the surfaces of said bit.

14. Method according to claim 13, including spraying said tungsten carbide refractory particles at feed rates from 1 to 12 pounds per hour.

15. Method according to claim 14, including selecting tungsten carbide particulate wherein said particles are from 10 to 33 microns in particle size.

16. Method according to claim 15, including thermally spraying said refractory particulate with a first combustion of fuel in a first chamber and a secondary combustion of fuel in a second chamber physically separate from and beyond the first combustion chamber, whereby said refractory particulate is sprayed in twice heated condition.

* * * * *